US005158283A

United States Patent [19]

Herkness, 2nd

[11] Patent Number: 5,158,283

[45] Date of Patent: Oct. 27, 1992

[54] PORTABLE CROQUET PRACTICE WICKET ASSEMBLY

[75] Inventor: Wayne Herkness, 2nd, Lewisburg, W. Va.

[73] Assignee: Damon Company of Salem, Inc., Salem, Va.

[21] Appl. No.: 833,123

[22] Filed: Feb. 10, 1992

Related U.S. Application Data

[63] Continuation-in-part of Ser. No. 748,878, Aug. 23, 1991, abandoned.

[51] Int. Cl.[5] ..... A63B 59/10

[52] U.S. Cl. ..... 273/56

[58] Field of Search ..... 273/56, 128 A, 128 B

[56] References Cited

U.S. PATENT DOCUMENTS

| | | | |
|---|---|---|---|
| 124,786 | 3/1872 | Brooks | 273/56 |
| 612,965 | 10/1898 | Gallup | 273/56 |
| 810,853 | 1/1906 | Griswald | 273/56 |
| 816.758 | 4/1906 | Stitchweh | 273/56 |
| 1,540,771 | 6/1925 | Foster | 273/56 |
| 1,583,244 | 5/1926 | Burris et al. | 273/56 |
| 1,784,818 | 12/1930 | Bump | 273/56 |
| 1,936,220 | 11/1933 | Ziebarth | 273/56 |
| 2,162,867 | 6/1939 | Smith | 273/56 |
| 3,464,697 | 9/1969 | Robillard, Jr. | 273/56 |
| 4,295,650 | 10/1981 | Kleeble | 273/56 |

FOREIGN PATENT DOCUMENTS

| | | | |
|---|---|---|---|
| 2632868 | 12/1989 | France | 273/127 B |

*Primary Examiner*—Theatrice Brown

*Attorney, Agent, or Firm*—J. Gibson Semmes

[57] ABSTRACT

Portable association croquet wicket practice assembly of three-point playing surface contact, defining a simulated target wicket wherein upright legs are fixedly spaced apart in regulation measure by a topmost transverse crown, the free ends of the legs being supported by surface contact, the target wicket being ballasted and balanced rearwardly by two interconnected weights, a first weight being elevated and fixed relative to the crown to apply vertical and horizontal moments to the wicket, a second weight being in slope declination relative to the first weight to apply target aligned and anchoring moments to the wicket. The wicket, per se, is white in the assembly foreground and neutral or dark in its background.

4 Claims, 1 Drawing Sheet

PORTABLE CROQUET PRACTICE WICKET ASSEMBLY

RELATED APPLICATIONS

This is a continuation-in-part of patent application Ser. No. 07/748,878, filed Aug. 23, 1991 (ABANDONED), entitled PORTABLE CROQUET WICKET ASSEMBLY. A related Design Pat. application Ser. No. 07/751,211, entitled PRACTICE WICKET ASSEMBLY WHEREIN COLOR IS DEPICTED was filed Aug. 28, 1991.

BACKGROUND OF INVENTION

American Croquet as it is played today, requires six wicket layout wherein each wicket shall be of round iron $\frac{5}{8}$ inch diameter and of uniform thickness. In the official rules currently promulgated by the United States Croquet Association for the American Six Wicket Game, the balls shall be colored respectively blue, red, black or yellow. They shall be $3\frac{5}{8}$ inches in diameter and of even weight, not less than $15\frac{3}{4}$ ounces nor more than $16\frac{1}{4}$ ounces. The wickets shall be 12 inches in height above the ground measured to the crown of the wicket, vertical and firmly fixed. The crown shall be straight and at right angles to the uprights, which shall not be less than 3-11/16 inches nor more than 4 inches apart uniformly between the uprights (inside measurement) provided that all wickets shall be painted white, the crown of the first wicket colored blue, and that of the last wicket which is known as the rover wicket, red.

This invention thus relates to the art of association croquet game play and is adapted to provide the player with a portable practice assembly. Together with mallet and ball, it may be used indoors or outdoors, apart from or upon a playing green.

Known croquet practice devices are represented by the following U.S. Pat. Nos.:

| PATENTEE | NUMBER | DATE | TITLE |
|---|---|---|---|
| Edward S. Foster | 1,540,771 | 06/09/25 | WICKET AND STAKE FOR INDOOR CROQUET |
| Lewis C. Bump | 1,784,818 | 12/16/30 | GAME |
| John E. Ziebarth | 1,936,220 | 11/12/32 | APPARATUS FOR PLAYING CROQUET |
| L. Julian Smith | 2,162,867 | 06/20/39 | RUG CROQUET WICKET |

SUMMARY OF INVENTION

The present croquet wicket practice assembly is characterized by portability, having a simulated target wicket, wherein upright legs are fixedly spaced apart in regulation measure by a topmost stringer or crown. The wicket is ballasted downwardly and rearwardly by two interconnected weights, a first weight being fixed, relative to the crown to apply vertical transverse balancing moments to the wicket. A second weight is spaced from and interconnected to the first weight to apply target-aligned transverse and anchoring moments to the wicket. The wicket, per se, is preferably white in the foreground and neutral or dark in the background, thus offering the player an unobstructed and highlighted wicket target. The assembly is adapted to three-point playing surface contact wherein the combined weight mass of the background far exceeds the weight mass of the wicket in the foreground.

The objective of invention is to provide the American Croquet player with a substantially rigid practice wicket which will effectively resist displacement by heavy ball, rolling contact during practice. Whereas the assembly comprising the invention is defined in terms of the game known as association croquet and the playing dimensions of the wicket are those currently established by the United States Croquet Association for the American Six Wicket Game, the invention may likewise be adapted to different wicket dimensions and related games wherein practice may lead to improved performance in playing contests. The assemblage lends itself to facile disassembly.

DESCRIPTION OF PREFERRED EMBODIMENTS

The portable croquet practice wicket assemblage of the invention is characterized by its anchoring three-point, surface contact configuration. The particular arrangement of elements comprising the assembly is such as to thus provide 360° lateral stability, irrespective of the playing surface upon which the assembly may be applied. The set arrangement of parts thus removably anchors the unit to the playing surface whereby, during practice, the assembly will resist any displacement forces relative to the playing or practice surface, be it a green outdoors or a rug-covered surface indoors, etc. It is readily assembled and disassembled for transport.

Enhancing the practicing objective of the assembly is the provision of color applied to the target wicket in the foreground which is white. It is likewise off-white or grey to black, applied to the connected elements in the background. Color is thus critical to the invention.

Figure 1:
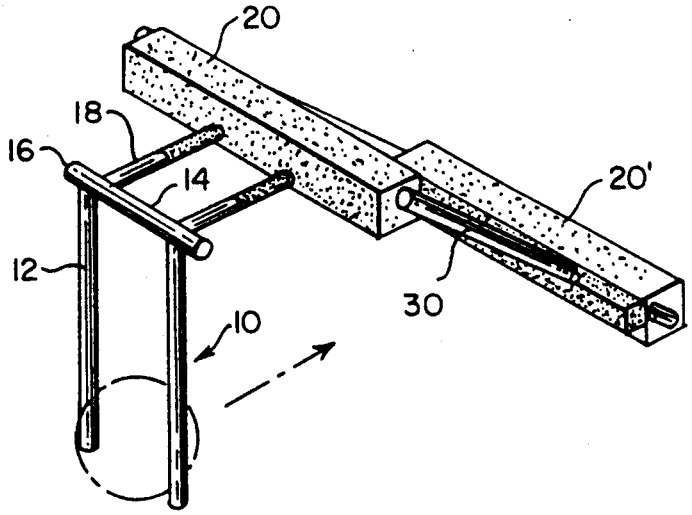
FIG. 1 is a view in perspective of the invention defined herein.
Figure 2:
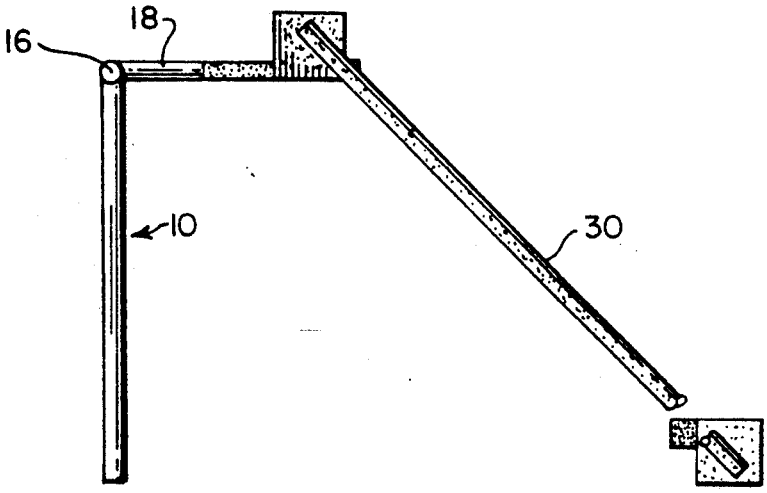
FIG. 2 is a side elevation view of the invention shown in FIG. 1.
Figure 3:
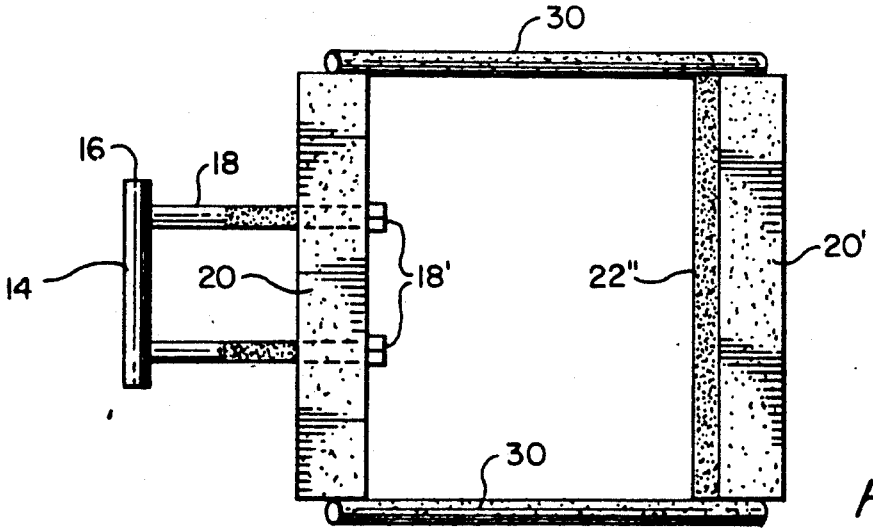
FIG. 3 is a to plan view of the invention depicted in FIGS. 1 and 2.

The assembly is best shown in FIG. 1 to comprise a wicket 10, the simulated wicket having substantially rigid, spaced apart legs 12 which are retained in vertical position by the transversely disposed stringer or crown 14, the ends 16 of which extend laterally from the wicket, a conventional measure. In short, the wicket consisting of the elements 12–14 is a replica of the conventional croquet wicket in size, coloring and spacing of the elements, lacking sub-surface penetrating extensions on the feet of the upright legs. The feet of the legs are preferably flat and formed by truncating the legs at bottom. Connecting the crown 14 to forward weight 20 are rearwardly extending connectors 18. Each connector passes through weight 20, to be fixed thereto by machine bolts 18'. Balance of the assembly is enhanced by means of braces 30 which join the in-line ballast weights 20—20'. In the configuration best shown in FIG. 2 the free ends of the wicket legs and the base of the weight 20' comprise a three-point contact with the playing or practicing surface. As also depicted in FIG. 2 braces 30 are fixed to respective ends of the weights at a 45° sloping displacement (angle). It will be noted from FIG. 3 that the transverse elongated dimension of the weights 20–20' substantially exceeds the external width created by the legs 12 of the wicket, tending together to provide vertical and transverse stability to the assembly, thus maintaining the wicket free of impediment. The center of gravity of the assembly is well behind the simulated wicket 10. With respect to weight 20' there is provided a rebound, not only for balls which may successfully pass through the wicket, but also any driven balls which may have missed the wicket altogether and passed to the side. Thus the weight 20' is provided with a ball cushion 22 extending the full width of the weight. See FIG. 2.

Whereas the invention has been defined in terms of the game of American Croquet, including the common nomenclature thereof, it is within the purview of invention to encompass all related games wherein the apparatus hereinafter claimed, may be used in pursuit of excellence in performance technique of said related games.

I claim:

1. A free standing wicket assembly comprising:

(A) a rearwardly disposed base ballast weight to be supported on a playing surface;

(B) a pair of rigid, horizontally spaced-apart weight braces, a rearward end of each brace being fixed to and extending forward to an inclined angle from said base ballast weight;

(C) a topmost ballast weight being parallel to and elevated relative to said ballast weight and a wicket, said topmost weight being fixed to a forward end of said brace members;

(D) a pair of rigid, spaced-apart connectors, said connectors, extending forward and below the center of gravity of the topmost ballast weight;

(E) a target wicket comprising a pair of elongated, rigid horizontally spaced-apart target legs, said legs having top attachment to a crown, the crown joining the upper ends of the legs to the connectors, said target wicket being disposed forward of both said ballast weights and having contact with the playing surface such that a ball rolling on the playing surface between said legs will impact against said base member.

2. The practice wicket assembly according to claim 1 wherein the respective weights are elongated transversely and disposed parallel to the horizontally spaced-apart target legs.

3. The practice wicket assembly according to claim 2 wherein the width of said base ballast weight is greater than the space defined by the target legs.

4. The practice wicket assembly according to claim 3 wherein said target legs have a color which is variable, relative to the color of the other elements of the wicket.

* * * * *